US005598815A

United States Patent [19]

Hertrich

[11] Patent Number: 5,598,815

[45] Date of Patent: Feb. 4, 1997

[54] ROLLER LEVER OF A CASTING MACHINE

[75] Inventor: Steffen Hertrich, Herzogenaurach, Germany

[73] Assignee: Ina Walzlager Schaeffler KG, Germany

[21] Appl. No.: 643,037

[22] Filed: May 2, 1996

Related U.S. Application Data

[63] Continuation of Ser. No. 373,748, Jan. 17, 1995, abandoned.

[30] Foreign Application Priority Data

Jan. 20, 1994 [DE] Germany ..... 9400898 U

[51] Int. Cl.[6] ..... B22C 9/22; F01L 1/18

[52] U.S. Cl. ..... 123/90.39; 123/90.41; 74/519; 74/559; 29/888.2

[58] Field of Search ..... 123/90.39, 90.41, 123/90.42, 90.43, 90.44, 90.46, 90.51; 74/519, 559; 29/888.2

[56] References Cited

U.S. PATENT DOCUMENTS

| | | | |
|---|---|---|---|
| 4,955,121 | 9/1990 | Sato et al. | 29/888.2 |
| 5,060,606 | 10/1991 | Hubbard | 123/90.39 |
| 5,251,585 | 10/1993 | Graber | 123/90.39 |

FOREIGN PATENT DOCUMENTS

| | | | |
|---|---|---|---|
| 159018 | 6/1994 | Japan | 123/90.39 |

*Primary Examiner*—Weilun Lo
*Attorney, Agent, or Firm*—Bierman & Muserlian

[57] ABSTRACT

A roller lever (1) of a casting material configured as a finger lever for a valve drive of an internal combustion engine and comprising a first end portion (2) and a second end portion (4) connected to each other by side walls (7, 8) whose central portions (6) define a free space (9) in which a rotatably mounted supporting roller (10) is guided, said side walls (7, 8) comprising, in a region of the supporting roller (10), circular ring-shaped running surfaces (13, 14) facing the free space (9), the roller lever (1) further comprising a mold parting line (15) resulting from manufacture in a casting mold having a mold parting, characterized in that the mold parting line (15) between two halves of the casting mold extends outside of the running surface (13, 14) along a peripheral contour (16) of the running surfaces (13, 14) and a roller lever of a casting material configured as a rocker arm for a valve drive of an internal combustion engine, one end region of the roller lever being a fork-shaped region for receiving a supporting roller, and side walls of said fork-shaped end region comprising circular ring-shaped running surfaces, the roller lever comprising mold parting line (15) resulting from manufacture in a casting mold having a mold parting, characterized in that the mold parting line (15) between two halves of the casting mold extends outside of the running surfaces (13, 14) along a peripheral contour (16) of the running surfaces (13, 14).

6 Claims, 3 Drawing Sheets

ROLLER LEVER OF A CASTING MACHINE

PRIOR APPLICATION

This application is a continuation of U.S. patent application Ser. No. 373,748 filed Jan. 17, 1955, now abandoned.

STATE OF THE ART

Roller levers configured as rocker arms, finger levers or roller tappets and used in valve drives of internal combustion engines are frequently made from cast blanks. The integration of a supporting roller in the roller lever requires additional functional surfaces, i.e. contact surfaces on which the rolling bearing and the supporting roller can run. To assure better lubrication, these running surfaces are made circular in shape.

Independent of the manufacture of the cast part, the mold parting must be chosen so that no undercutting occurs in the direction of removal. Hitherto, in the case of roller levers having circular running surfaces, a mold parting was used which extended across the circular running surface in the region of the largest longitudinal dimension thereof, crosswise to the direction of removal. This type of parting leads to the formation of a mold parting line extending over the running surface and this frequently results in a mismatch between the running surfaces which prevents the formation of a lubricant film on these surfaces. Moreover, the mold parting line causes flash formation which disturbs the lateral running contact of the rolling elements. To eliminate this disadvantage and assure the functioning of the supporting roller, a subsequent machining of the running surfaces is therefore necessary.

OBJECTS OF THE INVENTION

It is an object of the invention to enable the fabrication of a roller lever in which no subsequent machining of the running surfaces for the supporting roller is required.

It is another object of the invention to provide a casting mold which prevents flash formation on the running surfaces.

These and other objects and advantages of the invention will become obvious from the following detailed description.

THE INVENTION

The roller lever of the invention comprises a roller lever (1) of a casting material configured as a finger lever for a valve drive of an internal combustion engine and comprising a first end portion (2) and a second end portion (4) connected to each other by side walls (7, 8) whose central portions (6) define a free space (9) in which a rotatably mounted supporting roller (10) is guided, said side walls (7, 8) comprising, in a region of the supporting roller (10), circular ring-shaped running surfaces (13, 14) facing the free space (9), the roller lever (1) further comprising a mold parting line (15) resulting from manufacture in a casting mold having a mold parting, characterized in that the mold parting line (15) between two halves of the casting mold extends outside of the running surface (13, 14) along a peripheral contour (16) of the running surfaces (13, 14).

The roller lever of the invention of a casting material configured as a rocker arm for a valve drive of an internal combustion engine, one end region of the roller lever being a fork-shaped region for receiving a supporting roller, and side walls of said fork-shaped end region comprising circular ring-shaped running surfaces, the roller lever comprising mold parting line (15) resulting from manufacture in a casting mold having a mold parting, is characterized in that the mold parting line (15) between two halves of the casting mold extends outside of the running surfaces (13, 14) along a peripheral contour (16) of the running surfaces (13, 14).

The fact that the parting of the mold for the component to be cast extends along a peripheral contour of the running surface results in that the mold parting line extends outside of the running surfaces so that subsequent machining of the running surfaces is not required. Advantageously, the invention enables the fabrication of a roller lever without any kind of subsequent machining so that it can be mounted directly after casting. Thus, the roller lever of the invention is economical in production and particularly suitable for use in industrial scale manufacture. The roller lever of the invention can advantageously be configured as a finger lever or a rocker arm.

The invention also provides a casting mold in which the running surfaces are associated only with one mold half, i.e. either with an upper or a lower mold half. The casting mold of the invention has an asymmetric parting so that in the finished roller lever, a mold parting line is obtained which is similar to the known parting line, starts from an end portion and extends at first up to one end of the largest dimension or longitudinal axis of the running surface, but then follows half the periphery of the running surface and ends in a second end region.

This path of the mold parting line has the advantage that the lateral running surfaces are located in one mold half so that they do not comprise any irregularities caused by the mold, for example by a misalignment of the mold halves.

Figure 1:
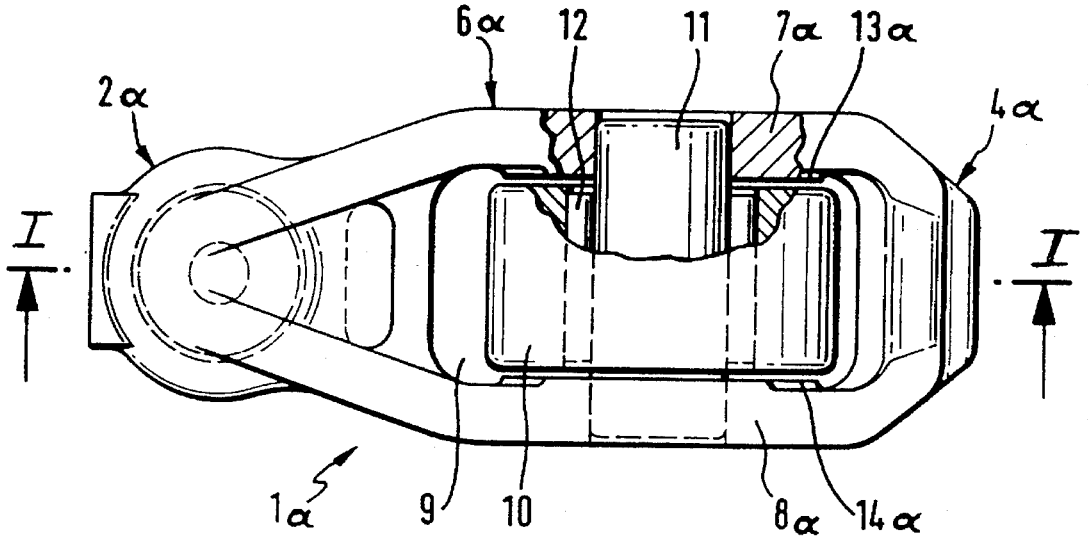
FIG. 1 is a top view of a roller lever of the invention.

The structure of the roller lever (1*a*) of the invention can be seen in FIG. 1. The cast roller lever (1*a*) comprises a first end portion (2*a*) having a cup-shaped recess (3) which can be engaged, for example, by a clearance compensation element. A second end portion (4*a*) is arranged opposite the end portion (2*a*) and comprises a groove (5) having an inverse U-shaped cross-section which can be engaged, for example, by the end of a shaft of an engine valve. Two spaced side walls (7*a*) and (8*a*) connect the end portions (2*a*) and (4*a*) and comprise a central portion (6*a*). Parallel portions of the side walls (7*a*) and (8*a*) enclose a free space (9) into which a supporting roller (10) is inserted. The supporting roller (10) is rotatably mounted with the help of a rolling bearing (12) on an axle (11) which is non-rotatably fixed in the side walls (7*a*, 8*a*). On their sides facing the free space (9), the side walls (7*a*, 8*a*) comprise axially projecting circular running surfaces (13*a*, 14*a*), which serve as guide or axial stops for the rolling elements of the rolling bearing (12) and for the supporting roller (10).

Figure 2:
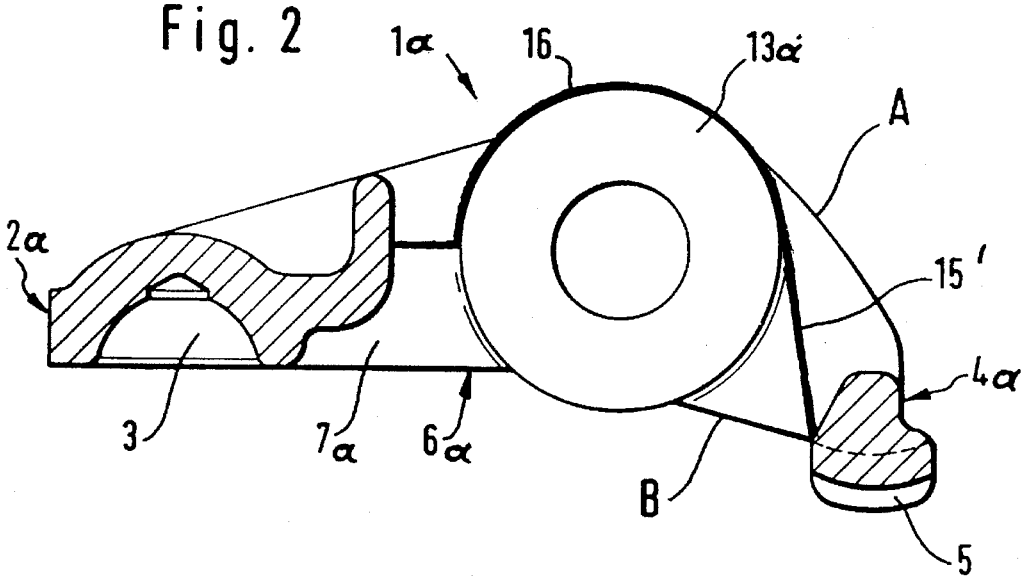
FIG. 2 is a cross-sectional view of the roller lever of FIG. 1 taken along line 1—1.

FIG. 2 with its sectional view of the roller lever (1*a*) along line 1—1 of FIG. 1, further clarifies the position of the running surface (13*a*). FIG. 2 also shows the path of a mold parting line (15') which divides the roller lever (1*a*) into an upper part "A" and a lower part "B". It can be seen that the mold parting line (15') extends along the peripheral contour (16*a*) of the running surface (13*a*) so that the entire running surface (13*a*) is associated with the lower part "B". To start with, the mold parting line 15' extends, as was hitherto usual, from the end portion (2*a*) to the region of the largest longitudinal dimension of the running surface (13*a*). In contrast to the known mold parting line, however, the mold parting line (15') then follows half the periphery of the running surface (13*a*) along the peripheral contour (16*a*). Following this, the mold parting line (15') extends from the running surface (13*a*) again along the hitherto known path to the end portion (4*a*). Due to this mold parting, no disadvantageously raised mold parting lines are formed on the running surfaces (13*a*) and (14*a*) which in the past made a subsequent machining necessary to obtain a desired large-surface contact for the rolling bearing (12).

Figure 3:
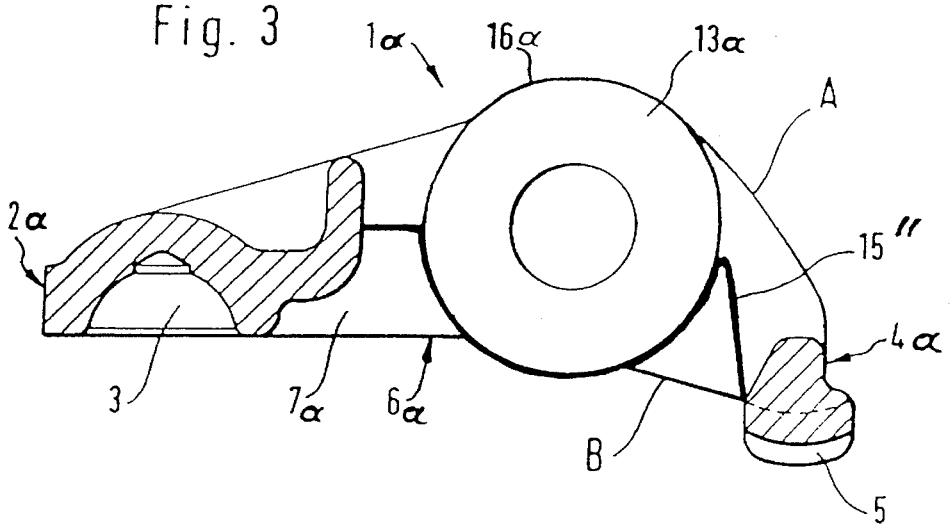
FIG. 3 is a cross-sectional view corresponding to that of FIG. 2 but showing a different mold parting line.

FIG. 3 also shows the roller lever (1*a*) in a longitudinal cross-section in which, in contrast to FIG. 2, the mold parting line (15") follows the lower periphery of the peripheral contour (16*a*) in the region of the running surface (13*a*).

Figure 4:
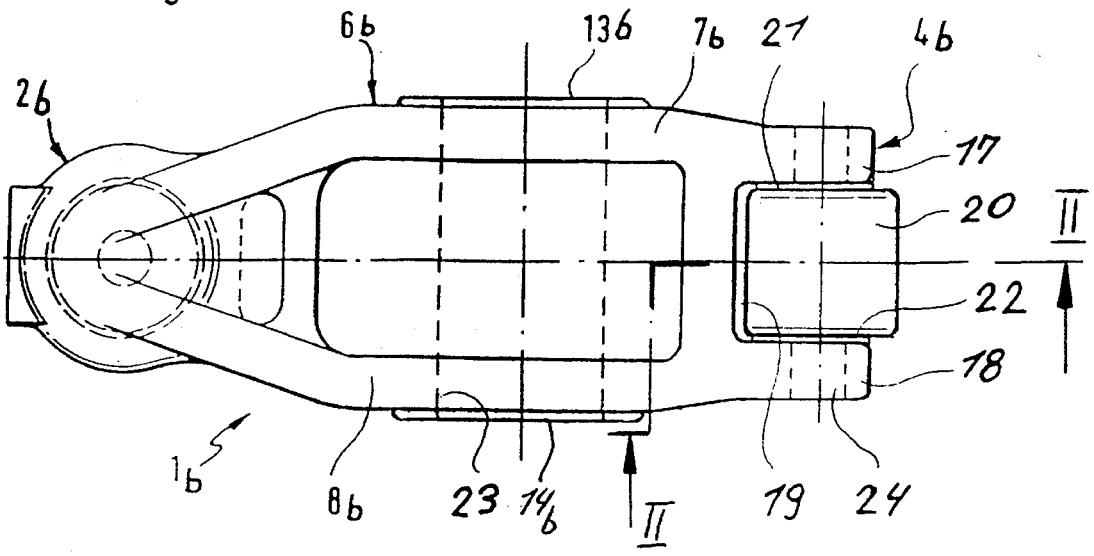
FIG. 4 is a top view of a roller lever of the invention configured as a rocker arm.

FIG. 4 shows a top view of a roller lever (1*b*) in the form of a cast rocker arm. The end region (2*b*) of the roller lever (1*b*) corresponds to that of the roller lever (1*a*). The opposite fork-shaped end region (4*b*) forms two side walls (17, 18) which are axially spaced to form a recess (19). These side walls (17, 18) comprise aligned bores (24) for receiving an axle on which a supporting roller (20) is rotatably mounted. In the installed state of the roller lever (2*b*), the supporting roller (20) force-engaged by a cam of a camshaft of an internal combustion engine. Running surfaces (21, 22) provides an axial guidance for the supporting roller (20). In the region of a central portion (6*b*), the roller lever (1*b*) comprises a receiving bore (23) which is parallel to the supporting roller (20). In the installed state, a bearing pin arranged in the bore (23) serves as an axis of rotation for the roller lever (1*b*). In the region of the receiving bore (23), the outer surfaces of the side walls (7*b*, 8*b*) form running surfaces (13*b*, 14*b*) which at the same time serve to axially guide the roller lever (1*b*).

Figure 5:
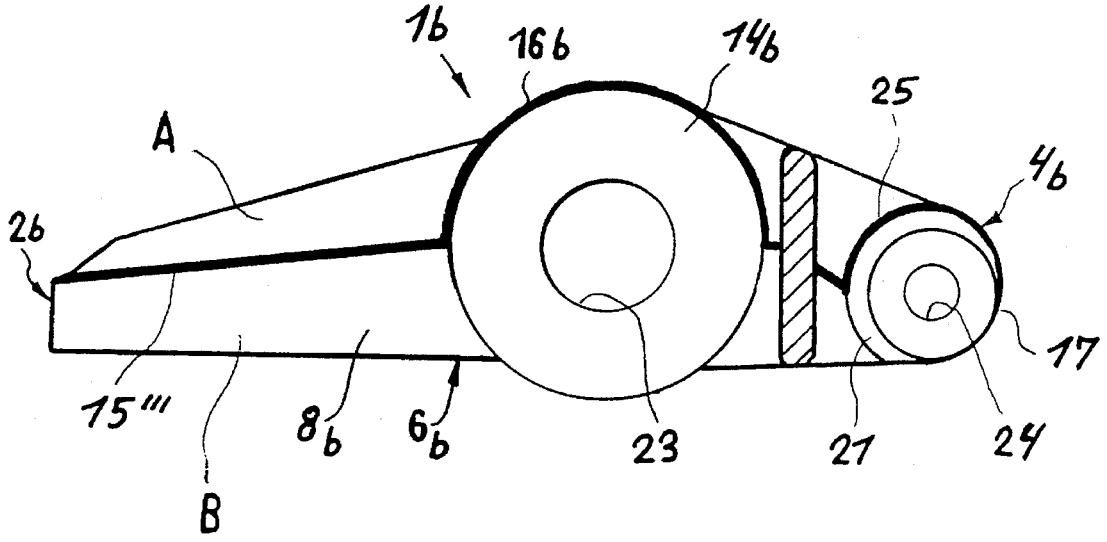
FIG. 5 is a longitudinal cross-section of the roller lever of FIG. 4 taken along line 11—11 of FIG. 4.

FIG. 5 shows the roller lever (2*b*) with a mold parting line 15'" which divides the roller lever (1*b*) into an upper "A" and a lower part "B" while following, similar to the roller lever (1*a*), the peripheral contour (16*b*, 25) of the running surfaces (14*b*, 21) so that said running surfaces (14*b*, 21) are associated with the lower part "B".

What is claimed is:

1. A rollde lever (1*a*) of a casting material configured as a finger lever for a valve drive of an internal combustion engine and comprising a first end portion (2*a*) and a second end portion (*a*) connected to each other by side walls (7*a*, 8*a*) whose central portions (6*a*) define a free space (9) in which a rotatably mounted supporting roller (10) is guided, said side walls (7*a*, 8*a*) comprising, in a region of the supporting roller (10), circular ring-shaped running surfaces (13*a*, 14*a*) facing the free space (9), the roller lever (1*a*) further comprising a mold parting line (15'; 15") resulting from manufacture in a casting mold having a mold parting, characterized in that the mold parting line (15'; 15") between two halves of the casting mold extends outside of the running surfaces (13*a*, 14*a*).

2. A roller lever of claim 1 wherein the running surfaces (13*a*, 14*a*) are associated with an upper part (A) of the roller lever (1*a*).

3. A roller lever of claim 1 wherein the running surfaces (13*a*, 14*a*) are associated with a lower part (B) of the roller lever (1*a*).

4. A roller lever (1*b*) of a casting material configured as a rocker arm for a valve drive of an internal combustion engine, one end region (4*b*) of the roller lever (1*b*) being a fork-shaped region for receiving a supporting roller (20), and side walls (17, 18) of said fork-shaped end region (4*b*) comprising circular ring-shaped running surfaces (21, 22), and running surfaces (13*b*, 14*b*) formed on side walls (7*b*, 8*b*) of the central portion (6*b*) are associated with a receiving bore (23), the roller lever (1'*b*) further comprising a mold parting line (15'") resulting from manufacture in a casting mold having a mold parting, characterized in that the mold parting line (15'") between two halves of the casting mold extends outside of the running surfaces (13*b*, 14*b*; 21, 22) along a peripheral contour (16*b*, 25) of the running surfaces (13*b*, 14*b*; 21, 22).

5. A roller lever of claim 4 wherein the running surfaces (13*b*, 14*b*; 21, 22) are associated with an upper part (A) of the roller lever (1*b*).

6. A roller lever of claim 4 wherein the running surfaces (13*b*, 14*b*; 21, 22) are associated with a lower part (B) of the roller lever (1*b*).

* * * * *